US006893357B1

(12) United States Patent
Bennett

(10) Patent No.: US 6,893,357 B1
(45) Date of Patent: May 17, 2005

(54) GOLF CLUB SUPPORT

(76) Inventor: Robert A. Bennett, 120 Sheffield Cir., Stratford, CT (US) 06614

( * ) Notice: Subject to any disclaimer, the term of this patent is extended or adjusted under 35 U.S.C. 154(b) by 0 days.

(21) Appl. No.: 10/713,965

(22) Filed: Nov. 14, 2003

(51) Int. Cl.[7] ..... A63B 55/10; A63B 57/00

(52) U.S. Cl. ..... 473/282; 473/285; 473/286; 473/408; 473/406

(58) Field of Search ..... 473/286, 408, 473/282, 406; D21/793, 796; D6/552; 211/70.2, 70.8; 172/378; 248/85, 688

(56) References Cited

U.S. PATENT DOCUMENTS 3,056,412 A * 10/1962 Wolfe ..... 131/328
D219,970 S * 2/1971 Salzmann ..... D22/147
5,116,046 A * 5/1992 Pace ..... 473/286
5,226,647 A * 7/1993 Notarmuzi ..... 473/284

* cited by examiner

*Primary Examiner*—Stephen Blau

(57) ABSTRACT

A thin elongated plastic member has at one end a golf club shaft receiving groove that is disposed between two opposite finger like supporting arms which extend longitudinally outward. The groove is integral with a first short slot extending longitudinally inward in opposite direction from the arms. Two oppositely disposed spaced apart scissor like prongs extend longitudinally outward and are separated by a second short slot extending longitudinally inward in opposite direction from the prongs.

3 Claims, 2 Drawing Sheets

GOLF CLUB SUPPORT

FIELD OF THE INVENTION

This invention relates to supports for golf clubs that hold club handles sufficiently high enough above the ground to keep to keep the handle clean and dry when the club is laid down in the course of a game of golf.

BACKGROUND OF THE INVENTION

U.S. Pat. No. 4,545,579 discloses a combination of a golf club and a golf club support wherein means are provided to attach the support to the handle of the club and movable support means which pivot with respect to the attaching means. The support is lockable in a closed position on the club handle or in its open supporting position.

The present invention is directed toward a golf club support that is easily attached or removed from a golf club and does not employ separate attaching and movable support means and does not employ any pivoting action of any type.

SUMMARY OF THE INVENTION

In accordance with the invention, a golf club support is provided for removably supporting at least one golf club with a handle having a shaft secured thereto. The shaft has a varying diameter near its handle and a smaller diameter near its head.

The support utilizes a thin elongated plastic member.

The member has at one end a golf club shaft receiving groove that is disposed between two opposite finger like supporting arms which extend longitudinally outward. The groove is integral with a first short slot extending longitudinally inward in opposite direction from the arms. The arms and slot define a first spring compressing said groove to hold the shaft tightly when said shaft is disposed in the groove. In use, the shaft is disposed in the groove and is slid along until it is positioned adjacent the handle of the club.

Means are disposed at the opposite end of the member for bearing against the ground when a golf shaft is disposed in the shaft receiving groove adjacent the handle to hold the handle high enough above the ground to keep to keep the handle clean and dry when the club is laid down in the course of a game of golf.

These means have two oppositely disposed spaced apart scissor like prongs extending longitudinally outward which are separated by a second short slot extending longitudinally inward in opposite direction from the prongs. These prongs and slot define a second spring for providing firm ground support.

The second slot of the member is surrounded by two like opposed recessed circular regions, one of said regions supporting like first and second spaced apart enlargements which extend longitudinally toward the prongs.

In use, in order to smooth a ball impact mark on the green after the ball is removed, the member is positioned so that the enlargements engage and smooth out the impact mark.

A flat circular marker disc detachably engages the other of said regions. The disc has a downwardly extending vertical post secured at one end to the center of the disc. The disc can be removed and used to identify a ball position after the ball has been removed by inserting the post into the ground with the disc exposed.

When the disc is in place in the member and engages the other of said regions, the post extends downward between said enlargement and is concealed between them.

DETAILED DESCRIPTION OF PREFERRED EMBODIMENT

Figure 3:
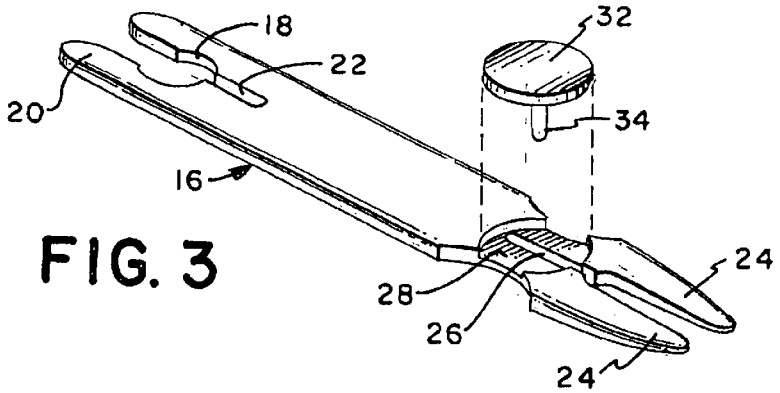
FIG. 3 is an exploded view of the support.
Figure 2:
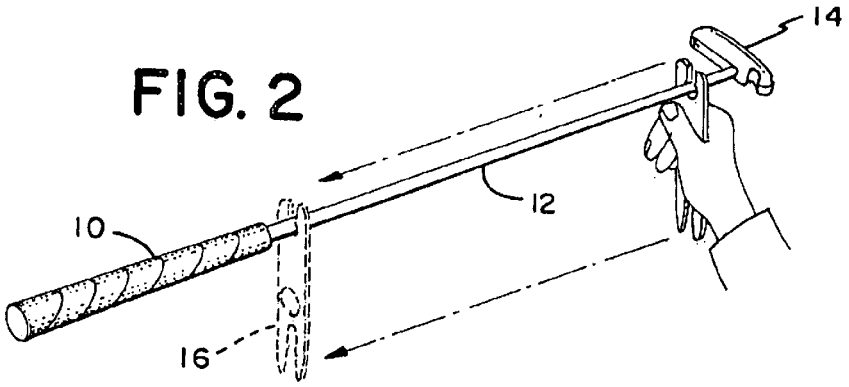
FIG. 2 shows the method of connecting the support to a golf club.
Figure 1:
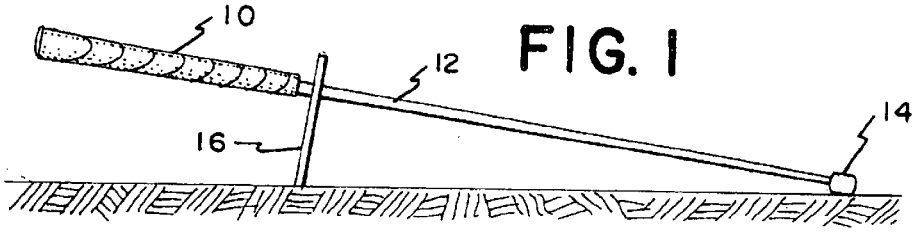
FIG. 1 is a view showing the golf club support in use.
Figure 4:
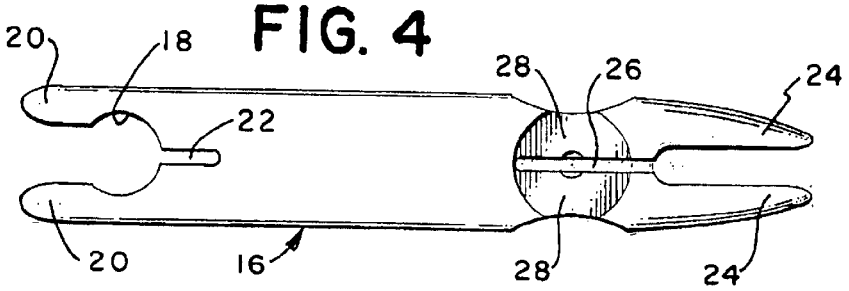
FIG. 4 is a plan view of the post with the marker disc removed.
Figure 5:
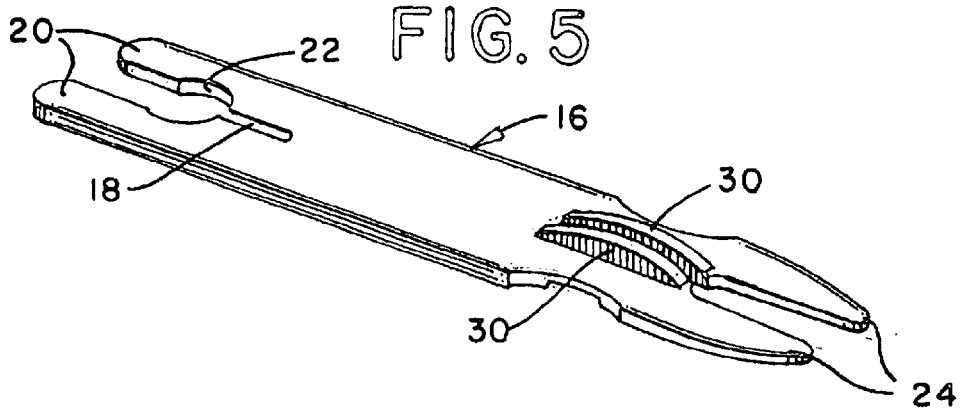
FIG. 5 is a bottom view of the post.
Figure 7:
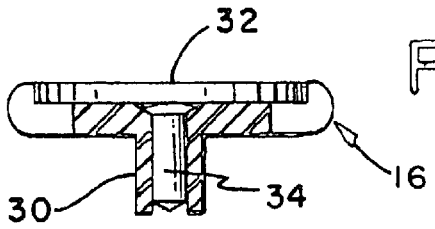
FIG. 7 is a view taken along the line 7—7 in FIG. 6.
Figure 6:
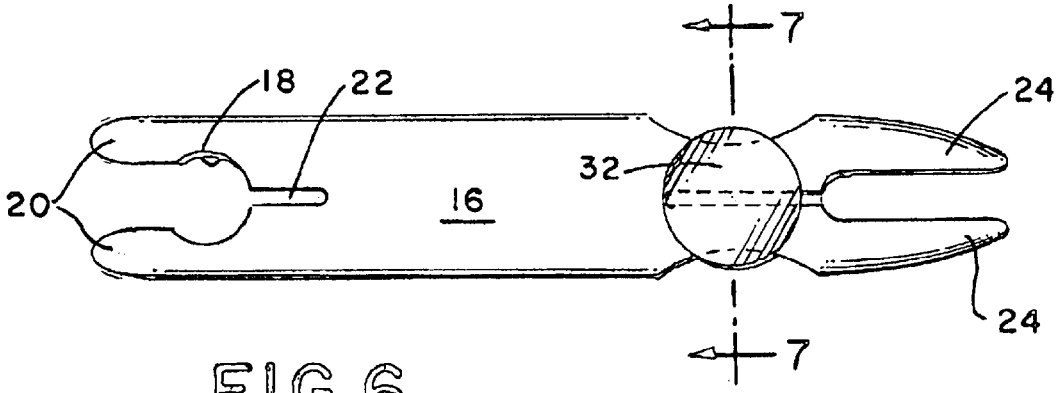
FIG. 6 is a plan view of the support with the marker disc installed.

FIGS. 1–7 show a preferred embodiment of this invention used for removably supporting at least one golf club with a handle 10 having a shaft 12 secured thereto. The shaft has a varying diameter near its handle and a smaller diameter near its head 14.

The support utilizes a thin elongated plastic member 16 having at one end a golf club shaft receiving groove 18 that is disposed between two opposite finger like supporting arms 20 which extend longitudinally outward. These groove are integral with a first short slot 22 extending longitudinally inward in opposite direction from the arms. These arms and slot define a first spring compressing said groove to hold the shaft tightly when said shaft is disposed in the groove. In use, the shaft is disposed in the groove and is slid along until it is positioned adjacent the handle of the club.

Means are disposed at the opposite end of the member for bearing against the ground when a golf shaft is disposed in the shaft receiving groove to hold the handle high enough above the ground to keep to keep the handle clean and dry when the club is laid down in the course of a game of golf.

This means has two oppositely disposed spaced apart scissor like prongs 24 extending longitudinally outward which are separated by a second short slot 26 extending longitudinally inward in opposite direction from the prongs. These prongs and slot defining a second spring for providing firm ground support.

The second slot 26 of the member is surrounded by two like opposed recessed circular regions 28. One of said regions supports like first and second spaced apart enlargements 30 which extend longitudinally toward the prongs. In use, in order to smooth a ball impact mark on the green after the ball is removed, the member is positioned so that the enlargements engage and smooth out the impact mark.

A flat circular marker disc 32 detachably engages the other of said regions, said disc having a downwardly extending vertical post 34 secured at one end to the center of the disc. The disc can be removed and used to identify a ball position after the ball has been removed by inserting the post into the ground with the disc exposed.

When the disc is in place in the member and engages the other of said regions, the post extends downward between said enlargement and is concealed between them.

While the invention has been described with particular reference to the drawings and claims, the protection sought is to be limited only by the terms of the claims that follow.

What is claimed is:

1. A golf club support for removably supporting at least one golf club with a handle having a shaft secured thereto, the shaft having a varying diameter near its handle and a smaller diameter near its head, said support comprising:

a thin elongated plastic member having at one end a golf club shaft receiving groove that is disposed between two opposite finger like supporting arms which extend longitudinally outward, the groove being integral with a first short slot extending longitudinally inward in opposite direction from the arms, said arms and slot defining a first spring compressing said groove to hold the shaft tightly when said shaft is disposed in the groove;

means disposed at the opposite end of the member for bearing against the ground when a golf shaft is disposed in the shaft receiving groove to hold the handle high enough above the ground to keep to keep the handle clean and dry when the club is laid down in the course of a game of golf, said means having two oppositely disposed spaced apart scissor like prongs extending longitudinally outward which are separated by a second short slot extending longitudinally inward in opposite direction from the prongs, the prongs and slot defining a second spring for providing firm ground support; and the second slot of the member is surrounded by two like opposed recessed circular regions and like first and second spaced apart enlargements which extend longitudinally toward the prongs.

2. The support of claim 1 further including a flat circular marker disc detachably engaging the other of said regions, said disc having a downwardly extending vertical post secured at one end to the center of the disc.

3. The support of claim 2 wherein when said disc engages the other of said regions, the post extends downward between said enlargements and is concealed between them.

* * * * *